United States Patent [19]

Leibrock et al.

[11] Patent Number: 4,533,002

[45] Date of Patent: Aug. 6, 1985

[54] DEVICE FOR GRIPPING AND RAISING TAMPING TOOLS OR FOR HOLDING RAISED TAMPING TOOLS IN A TAMPING MACHINE WHICH IS ESPECIALLY USED FOR THE PACKING OF COKING COAL

[75] Inventors: Kurt Leibrock, Völklingen; Hans-Jürgen Killich, Sulzbach, both of Fed. Rep. of Germany

[73] Assignee: Saarbergwerke Aktiengesellschaft, Saarbrucken, Fed. Rep. of Germany

[21] Appl. No.: 407,921

[22] PCT Filed: Dec. 15, 1981

[86] PCT No.: PCT/DE81/00222

§ 371 Date: Aug. 13, 1982

§ 102(e) Date: Aug. 13, 1982

[87] PCT Pub. No.: WO82/02055

PCT Pub. Date: Jun. 24, 1982

[30] Foreign Application Priority Data

Dec. 16, 1980 [DE] Fed. Rep. of Germany ..... 3047339
Dec. 16, 1980 [DE] Fed. Rep. of Germany ..... 3047400

[51] Int. Cl.[3] ..... E21B 1/00

[52] U.S. Cl. ..... 173/53; 44/10 G; 44/11; 44/2; 100/209

[58] Field of Search ..... 173/53, 54, 55, 56, 173/129, 130, 131; 425/457, 469; 44/2, 106, 11; 100/209

[56] References Cited

U.S. PATENT DOCUMENTS

| | | | |
|---|---|---|---|
| 1,764,223 | 6/1930 | Oster | 173/129 |
| 2,330,360 | 9/1943 | Hill | 173/129 |
| 3,034,588 | 5/1962 | MuBerry et al. | 173/129 |
| 3,109,500 | 11/1963 | Glamor | 173/131 X |
| 3,149,851 | 9/1964 | Adams | 173/131 X |
| 3,207,236 | 9/1965 | Shriver et al. | 173/53 |
| 3,454,113 | 7/1969 | Holtz | 173/129 X |
| 3,499,497 | 3/1970 | Moore | 173/129 |
| 3,511,325 | 5/1970 | Schmidt | 173/131 |
| 4,108,610 | 8/1978 | Leibrock | 44/10 G |
| 4,111,664 | 9/1978 | Leibrock | 44/10 |
| 4,123,216 | 10/1978 | Leibrock | 425/431 |
| 4,128,402 | 12/1978 | Leibrock et al. | 44/11 |

FOREIGN PATENT DOCUMENTS

| | | | |
|---|---|---|---|
| 004029 | 5/1901 | Fed. Rep. of Germany . | |
| 169079 | 10/1902 | Fed. Rep. of Germany . | |
| 156704 | 8/1903 | Fed. Rep. of Germany . | |
| 168599 | 1/1905 | Fed. Rep. of Germany . | |
| 197470 | 5/1906 | Fed. Rep. of Germany . | |
| 219928 | 6/1908 | Fed. Rep. of Germany . | |
| 2618327 | 11/1977 | Fed. Rep. of Germany . | |
| 352992 | 9/1905 | France . | |
| 2349636 | 11/1977 | France . | |
| 775229 | 10/1980 | U.S.S.R. | 173/53 |

*Primary Examiner*—E. R. Kazenske
*Assistant Examiner*—Willmon Fridie, Jr.
*Attorney, Agent, or Firm*—Nils H. Ljungman

[57] ABSTRACT

In a device for gripping and lifting tamping tools or for holding raised tamping tools in a tamping machine, the individual tamping tools rods are clamped in abutments (2) by slideable clamping members (3). In the device for lifting tamping tools, a controllable working cylinder (6), connected to each abutment (2), raises and lowers the abutment (2). An additional non-controllable cylinder (5) is connected to the clamping member (3) which has cylinder chambers which are connected to a non-pressurized tank of working fluid. This cylinder (5) opposes the movement of the abutment (2) because of the volume displaced from the cylinder chambers. At the initiation of the lifting stroke, the clamping member (3) is pulled tightly into the abutment and thus the tamping tool rod is clamped and lifted along therewith. At the beginning of the lowering motion of the abutment (2), the clamping member is disengaged by the action of the cylinder (5), thus releasing the tamping tool (4). In the device, for holding the raised tamping tools, the abutment (2) is affixed to the frame of the tamping machine, while the clamping member (3) is controlled by a pressurized cylinder (16) for engagement with or disengagement from the abutment (2).

13 Claims, 2 Drawing Figures

DEVICE FOR GRIPPING AND RAISING TAMPING TOOLS OR FOR HOLDING RAISED TAMPING TOOLS IN A TAMPING MACHINE WHICH IS ESPECIALLY USED FOR THE PACKING OF COKING COAL

FIELD OF THE INVENTION

The invention relates to a device for gripping and lifting of tamping tools, as well as, a device for holding raised tamping tools in a tamping machine, which is used especially for the packing of coking coal.

BACKGROUND OF THE INVENTION

A process is known, in which poorly coking coal and coal mixes are used, which only produces coke having low mechanical strength. In the bulk operation in this process, the coal is packed by tamping into a coke charge mold, outside of the oven chamber. The tamping is done by means of free-falling tamping tools, and the coal is then fed into the oven chamber and coked in the usual manner.

The tamping tool rods, having friction linings attached thereto, are raised by eccentric cam discs which are firmly attached on counter-rotating cam shafts, which shafts are mounted alongside one another. The cams clamp the tamping tool rods by making contact with the rods, at a point on the cam circumference during each rotation. Because of the slippage associated with the rolling friction, between the lift cams and the tamping tool rod linings, these parts are subjected to a very high, and moreover, locally variable wear. An even and constant lifting stroke of the tamping tools is not assured any longer. After a longer period of use, such heavy wear may even result, that the individual tamping tools are not picked up and lifted anymore, by the associated lift cam pairs. The adjustment of the lift shafts for compensation of wear, or for that matter, the setting of the contact pressure between the tamping tool rods and lift cams is extremely expensive and time consuming.

Further, it is known to use eccentrically pivoted segmented discs, as so-called tamping tool locks, for clamping the raised tamping tool rods while the coal charge is charged into the oven chamber. These tamping locks are swivelable about horizontal axes. These tamping locks, by the action of their own weight and their eccentric support, clamp the tamping tool rods.

Another available proposal was to mount such tamping tool locks on a lifting arrangement, which then is moved up and down. The tamping tool locks clamp the tamping tool rods, when the lifting process is started, and lift the tamping tools. When in the uppermost position, the tamping tools are released by the action of a protrusion, firmly attached to the tamping lock rod, striking a fixed stop on the tamping device and thereby turning the tamping lock shafts.

The design of this lifting arrangement, as well as, the manner in which the tamping tool lock shafts are supported, are very complex. Furthermore, the extensive wear of the tamping tool rods and the tamping tool locks still persists. The tamping tool locks must rest against the stops until the corresponding tamping tool has fallen onto the coal, to be packed, so that, only then can the lifting gear be lowered. The lifting arrangement and the tamping tool rods are guided separately in the frame of the tamping device. This brings about the risk of jamming the tamping rods.

Because of slippage, the friction linings must be glued onto the tamping tool rods. Because of this, an expensive, heat resistant arrangement is required. Old friction linings must be ground off before new linings can be applied, requiring special suction devices and protective measures because of the high asbestos content of these linings.

The object, of this present invention, is to provide a device for the lifting of the tamping tools, as well as, a device for holding raised tamping tools in a tamping machine, which devices are especially simple in design, reliably minimizing slippage, and easily and inexpensively maintained. The lifting device should, especially, assure a constant tamping tool lifting stroke, during extended periods of operation.

SUMMARY OF THE INVENTION

The object of this invention is achieved by providing each tamping tool with an associated abutment which has one first inner surface that is parallel to the tamping tool rod, and a second inner surface, opposite to the first one, forming a given angle, which opens upward, with the tamping tool rod, and that a slideable clamping member engages between said tamping rod and the second inner surface.

BRIEF DESCRIPTION OF THE DRAWINGS

The above, as well as other features and advantages of the present invention, will become apparent through consideration of the detailed description in connection with the accompanying drawings in which.

DETAILED DESCRIPTION OF THE INVENTION

The proposed device is distinguished by an especially simple design. The tamping tool rod is engaged by the clamping member immediately at the start of the lifting motion, and remains gripped, in a self-locking manner, during the lifting operation. Slippage is thereby reliably prevented, independent of the tamping tool weight. Friction linings, on the tamping tool rod, are no longer required. They are provided preferably on the surfaces of the abutment and the clamping members which make contact with the tamping tool rods. Since there is no slippage, they can simply be attached by riveting. The clamping member itself can be replaced without special requirements. Preferably, wedges are used as clamping members wherein the wedge shape corresponds to the angle between tamping tool rod and the abutment's associated contacting surface. A suitable force generating element actuates the clamping and loosening action of the clamping member, whereby the direction of the generated force is opposite to the associated movement of the abutment, so that, the clamping member is engaged with the wedge seat during initiation of the lifting motion, and is disengaged at the beginning of the downward motion, so that, the tamping tool rod can fall freely.

Such suitable force generating elements are, for example, hydraulically or pneumatically operating damper systems, if they provide a sufficient vertical stroke. A special advantage is provided by a hydraulic cylinder, having a piston stroke which corresponds at least to the abutment's required vertical stroke. This cylinder is not pressurized but the two cylinder chambers are rather connected directly to a hydraulic tank. The resistance to the flow of the displaced hydraulic fluid counteracts the forced movement of the piston, and so generates a force, in the opposite direction to the movement of the abutment, required for engaging and disengaging of the clamping member.

The raising and lowering of the abutment is performed, in an especially simple manner, with a second, controlled cylinder having cylinder chambers which are pressurized alternatingly. However, any other suitable lifting device may also be used.

In an alternative embodiment of the invention, the device can be used preferably as a so-called tamper tool lock for holding raised tamping tools. In this case, the abutment is affixed to the framework of the tamping machine, while a suitable sliding motion generating device, for example, a pneumatic or hydraulic cylinder, moves the clamping member which is preferably a wedge. During the tamping operation, the clamping member is held in a loose condition, out of engagement with the abutment by the sliding motion generating device, whereas during standstill, the clamping member is pushed tightly into contact with the abutment, in order to hold the raised tamping tool.

Figure 1:
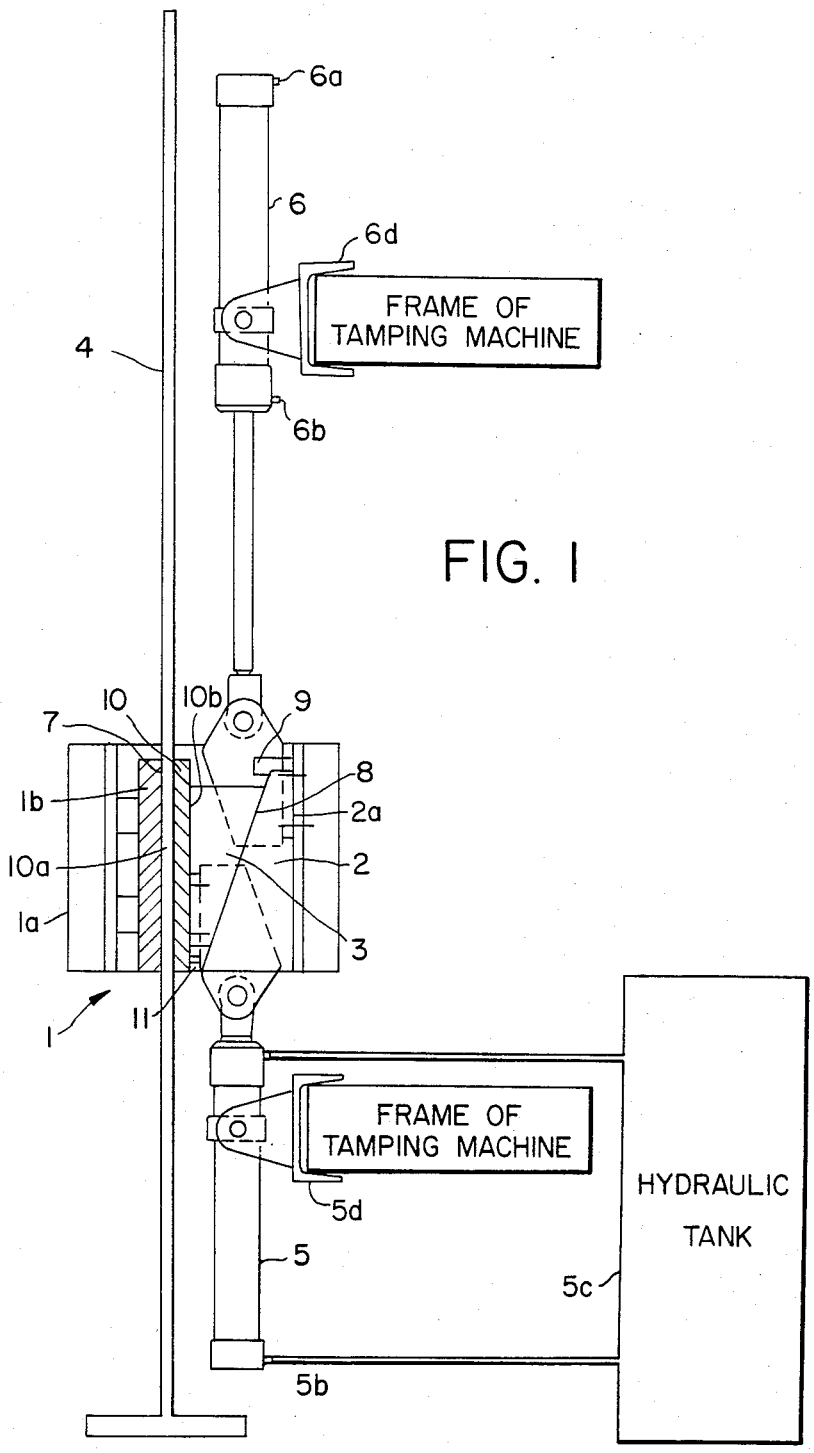
FIG. 1 is a partial sectional view of a device for the gripping and lifting of tamping tools in a tamping machine, all according to the present invention.

In FIG. 1, a tamping tool rod 4 is shown which is associated with its gripping device 1. The gripping device 1 has a body 1*a*. The body 1*a* has attached thereto and contains therein a gripping, first friction lining 1*b*. The gripping, first friction lining 1*b* abuts the tamping tool rod 4 on one side thereof along a first inner surface 7 of the lining 1*b*. A second friction lining 10 is disposed opposite the first gripping friction lining 1*b*, and abuts the tamping tool rod 4 on the other side thereof, and makes contact with the tamping tool rod 4 along a surface 10*a*. A first wedge 3 is adjacent to the second friction lining 10. The first wedge 3 is within the body 1*a* and abuts a surface 10*b* which surface 10*b* is opposite the surface 10*a*. A second wedge 2 abuts the first wedge 3 along a surface 8 thereinbetween. A surface 2*a* of the second wedge 2, opposite the surface 8, abuts against an inner surface of the body 1*a*. A stop 9 extends into a cavity in the body 1*a* over the second wedge 2. The stop 9 extends beyond the upper end of the second wedge 2 above the first wedge 3. The surfaces 10*b* and 8 lie along the left surface and the right surface of the first wedge 3, respectively, and form an acute angle opening upward.

The surface 8 when associated with the second wedge 2 forms an acute angle with respect to the first inner surface 7 and surfaces 10*a* and 10*b* and the tamping tool rod 4. The surface 8 associated with the second wedge 2 and the surface of the tamping rod adjacent to the surface 10*b* of the second friction lining 10 form a cavity in the form of a seat for receiving the first wedge 3. Surfaces 10*a* and 10*b* are parallel to a longitudinal axis of the tamping tool rod 4.

Any other suitable clamping member, than the first wedge 3 for example, a clamping roller, may also be used. A hydraulic cylinder 5, which is not pressurized, actuates the first wedge 3. Cylinder chambers 5*a*, 5*b* are connected to a hydraulic tank. The hydraulic cylinder 5 has a bracket 5*d* which is preferably attached to the frame of the tamping machine but may be connected to any stable point of reference with respect to the coke charge.

A second hydraulic cylinder 6 engages second wedge 2, having cylinder chambers 6*a* and 6*b*, which are pressurized alternately for raising and lowering the gripping device.

In the exemplary embodiment of FIG. 1 the second wedge 2 is raised when the hydraulic cylinder 6 is retracted. The hydraulic cylinder 6 is attached to a holding arrangement such as a bracket 6*d* which holds the hydraulic cylinder 6 stationary with respect to the coal in the coke charge mold and to the coke charge mold. The bracket 6*d* is preferably attached to the frame of the tamping machine but may be connected to any stable point of reference with respect to the coke charge. Due to the flow resistance of the volume to be displaced from the cylinder chamber 5*a* of the cylinder 5, the wedge 3 is initially retarded, at the outset of the lifting motion, and pressed against the tamping tool rod 4. If the wedge angle is appropriately chosen, the wedge is self-locking, so that, the tamping tool rod 4 remains tightly gripped, irrespective of its weight, during the entire lifting motion. Thereby, cylinder 5 is forced to extend.

After completing the lifting motion, the direction of motion of the hydraulic cylinder 6 is reversed by the pressurization of the cylinder chamber 6*a*, so that, the cylinder 6 is extended once again and the first wedge 3 and gripping device 1 are lowered. The volume now displaced from the cylinder chamber 5*b* of the cylinder 5 prevents the first wedge 3 from immediately following the downward movement of the second wedge 2, so that, the first wedge 3 is disengaged and the tamping tool rod 4 falls freely onto the coal to be packed. Only when the wedge 3 rests against a stop 9 in the body 1*a*, is it forced to descend and the piston of the cylinder 5 is again retracted. The downward movement of the abutment 2 may be simultaneous with the falling of the tamping tool rod 4.

The abutment 2 is not specifically supported by the frame of the tamping device 1 but is guided directly by tamping tool rod 4.

The hydraulic cylinder 6 is preferably controlled by means of a so-called differential arrangement. Thereby, the hydraulic fluid, displaced from the cylinder chamber 6*b*, when the cylinder 6 is extended, flows directly into the cylinder chamber 6*a*, so that, the hydraulic pump need only deliver the difference in volume corresponding to the piston rod volume.

Any slippage is reliably prevented because of the solid gripping of the tamping tool rod 4 between the first gripping element 1*b* and the second gripping element 10 by the force produced by the interaction of the second wedge 2 and the first wedge 3. Friction linings 1*b* and 10, which are riveted to the surfaces of the second wedge 2 and the first wedge 3, respectively make contact with the tamping tool rod 4. Any wear of the friction linings 10 is automatically compensated for by the displacement of the wedge 3. The position of the gripped first wedge 3, relative to a mark 11 on the body 1*a*, permits the checking of the friction lining thickness in a simple manner.

DETAILED OPERATION OF THE EMBODIMENT OF FIG. 1.

During an upstroke, the hydraulic cylinder 6 raises the second wedge 2 which presses against the first wedge 3 which in turn, by the action of the second friction lining 10, grips the rod 4 in coaction with the first friction lining 1*b* whereby the rod 4 is raised. Just after the top of the upstroke when the hydraulic cylinder 6 begins its downstroke the second wedge 2 moves downwardly, the first wedge 3 cannot follow because of the retarding action of the hydraulic cylinder 5 attached to the first wedge 3. Therefore, a gap is formed between the first wedge 3 and the second wedge 2 along the surface 8 therebetween thereby releasing the gripping action of the first friction lining 1*b* and the second friction lining 10 on the rod 4 whereupon the rod 4 falls. Immediately thereafter, the stop 9 makes contact with the first wedge 3 during the downstroke whereby the first wedge 3 is pushed down by the hydraulic cylinder 6 along with the second wedge 2 and the body 1*a*.

The unpressurized hydraulic cylinder 5 is connected to chambers 5*a* and 5*b* of the hydraulic tank 5*c*. The characteristics of the chambers 5*a* and 5*b*, and the hydraulic tank 5*c*, are chosen, as is well known to one skilled in the art, to retard the first wedge 3 to release the gripping device 1 at the beginning of the downstroke. When the stop 9 pushes against the first wedge 3 forcing it downward, the fluid therein is forced out of the cylinder chamber 5*b* and into cylinder chamber 5*a*. As the gripping tool 1 is raised, the fluid in cylinder chamber 5*a* is forced therefrom and fluid is forced into cylinder chamber 5*b*. The use of the hydraulic cylinder 5 with the chambers 5*a* and 5*b*, and the hydraulic tank 5*c*, permits the operation of the unpressurized cylinder by a simple connection of the chambers 5*a* and 5*b* to the hydraulic tank 5*c* without the use of valves, pressurization systems, etc.

Figure 2:
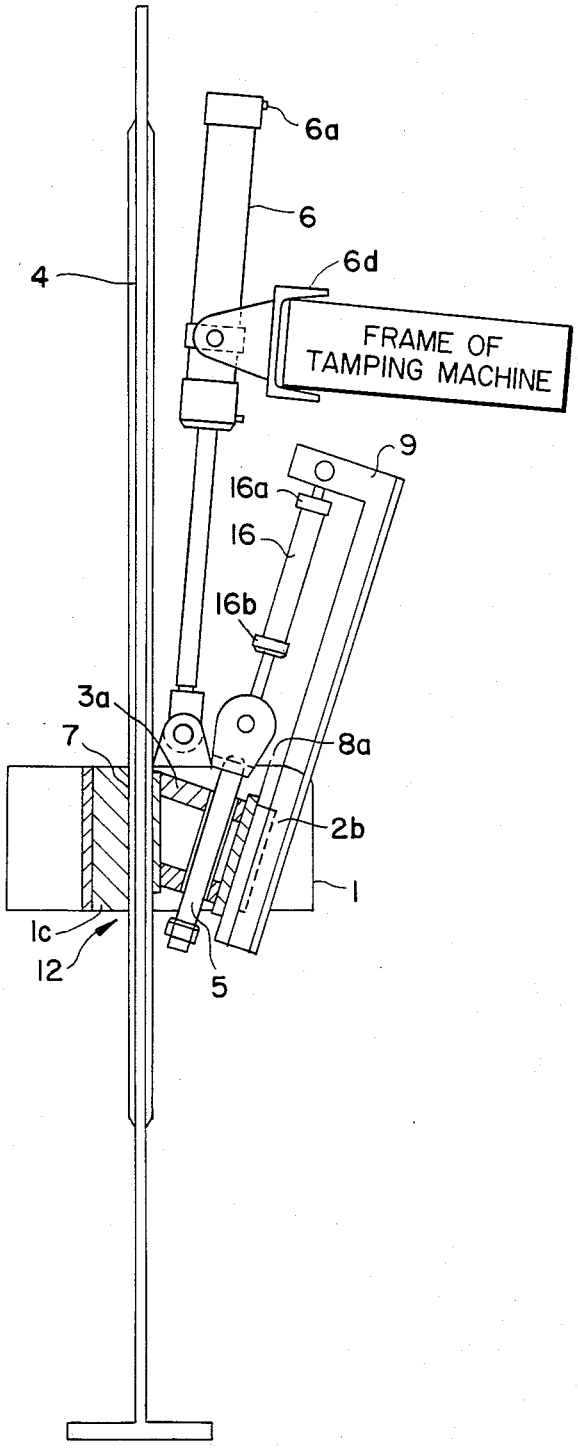
FIG. 2 is a partial sectional view of a device for holding raised tamping tools in a tamping machine, all according to this invention.

In the device for holding the raised tamping tools, a tamping lock 12 is associated with each tool lock 4 (FIG. 2). The tamping tool lock is attached to the frame structure of the tamping device, in a manner not shown. The tamping tool lock 12 comprises a body 1*a* with an inner portion 2*b* thereof having an inner surface 8, a clamping member or wedge 3*a* guided by the inner surface thereby, which clamping member 3*a* is shown as wedge in the exemplary embodiment. The body 1*a* has disposed therein a first friction lining 1*c* which has a first inner surface 7 which is parallel to the tamping tool rod 4 and rests thereagainst; the inner portion 2*b* of the body 1*a* has a second inner surface 8*a* which is opposite to the first inner surface 7 and is angled to the tamping tool rod 4, thus forming with it a wedge seat which is open upward, into which the wedge 3*a* engages. A cylinder 16 is connected to the wedge 3*a* and is supported by a bracket 9 attached to the body 1*a*. *When retracted by the cylinder 16, the wedge 3a* is disengaged from the wedge seat formed within the body 1*a*, thus freeing the tamping tool rod 4. Upon release of the pressure in the cylinder 16, the wedge 3*a* slides back into the wedge seat by the action of its own weight and clamps the tamping tool rod 4 with a self-locking action. However, it is desirable to provide a double acting cylinder which aids this self-locking action of the wedge 3*a*, by the pressurization of a cylinder chamber 16*a*. *A hydraulic cylinder 6 is attached to the body 1a* as in FIG. 1 to raise and lower the gripping device 1.

The devices, according to this invention, are expected not to develop problems because the wedge 3*a* is easily disassembled. Compared with known tamping devices with eccentric lifter cam discs, the proposed design allows a higher frequency of lifting of the individual tamping tools. Since no space is needed for the lifter shafts and discs, the tamping tools can be arranged close to one other. The required horizontal movement, up until the present time, of the tamping units, in order to be able to cover the entire surface of the coal to be packed, can be eliminated, or at least the required displacement can now be made very small. This means the increase in the absolute number of strokes per unit time, of the individual tamping tools, produces a further increase of the machine's tamping energy, and therefore, a still further performance increase compared with the previously known devices. Moreover, it is possible to assign two adjacent lift devices to one lifting cylinder 6.

I claim:

1. A device for gripping and raising individual tamping rods in a tamping machine having a plurality of rods, said device comprising:

body means for being disposed about an associated one of said plurality of rods, said body means having a first portion on one side thereof;

a first frictional gripping means connected to said first portion and being disposed substantialy within said body means;

a frictional, first inner surface on said first frictional gripping means for being substantially parallel to and for making frictional contact with a first side of its associated tamping rod;

a second portion of said body means forming a second inner surface, said second portion being on a side of said body means opposite said first portion;

a cavity being formed in said body means by said first inner surface and said second inner surface, said cavity having a shape which is at least a portion of a wedge, said wedge-shaped cavity comprising an upper portion, opening upwardly, and a lower portion, said first inner surface and said second inner surface having an angular relationship therebetween and converging from said upper portion of said cavity towards said lower portion of said cavity such that said first inner surface and said second inner surface are further apart at said upper portion than at said lower portion of said wedge-shaped cavity;

slidable clamping means being disposed at least partially within said wedge-shaped cavity;

a second frictional gripping means disposed for making frictional contact with said associated tamping rod on a second side thereof opposite to said first side of said associate tamping rod of said body means;

a first part of said slidable clamping means being disposed to act upon said second frictional gripping means so that said second frictional gripping means and said frictional, first inner surface of said first frictional gripping means grip said associated rod when said slidable clamping means is seated within said wedge-shaped cavity;

a second part of said slidable clamping means for making contact with said second inner surface of said second portion of said body means when said slidable clamping means is seated within said wedge-shaped cavity;

means for moving said slidable clamping means upwardly within said wedge-shaped cavity with respect to said body means for releasing the frictional contact between said slidable clamping means and its said associated tamping rod whereupon said associated tamping rod falls substantially freely from said gripping device; and means for raising and lowering said body means.

2. The device according to claim 1 wherein said second portion of said body means including an inverted wedge, with its larger portion facing downwardly, one side of said inverted wedge comprising said second inner surface of said second portion of said body means.

3. The device according to claim 2 wherein said means for moving said slidable clamping means upwardly includes means for moving said slidable clamping means downwardly to seat said slidable clamping means in said wedge-shaped cavity.

4. The device according to claim 3 wherein the means for moving said slidable clamping means upwardly is a hydraulic cylinder.

5. The device according to claim 1 wherein the slidable clamping means comprises a wedge.

6. The device according to claim 1 wherein the means for moving said slidable clamping means upwardly within said wedge-shaped cavity (5) is a hydraulic cylinder, the chambers of which (5*a*, 5*b*) are connected to a hydraulic tank.

7. The device according to claim 1 wherein said means for raising and lowering said body means (6) is connected with the body means.

8. The device according to claim 7 wherein the means for raising and lowering said body means (6) is a hydraulic cylinder.

9. The device according to claim 1, wherein the device is solidly connected to the frame of the tamping machine.

10. The device according to claim 9, with said means for raising and lowering said body means (6) and providing sliding motion to engage the slidable clamping means (3).

11. The device according to caim 10 wherein the means for raising and lowering said body means (6) and providing sliding motion is a hydraulic cylinder.

12. The device according to claim 9 wherein the movable clamping means (3) is a wedge.

13. The device according to claim 10 wherein said means for raising and lowering said body means (6) is a pneumatic cylinder.

* * * * *